United States Patent [19]

Simpson

[11] Patent Number: 4,581,997

[45] Date of Patent: Apr. 15, 1986

[54] INDUCED CURRENT-PROOF DETONATING SYSTEM AND METHOD

[76] Inventor: Ted Simpson, 231 Banbury Rd., Columbia, S.C. 29210

[21] Appl. No.: 617,925

[22] Filed: Jun. 6, 1984

[51] Int. Cl.[4] ..... F42D 5/04

[52] U.S. Cl. ..... 102/200

[58] Field of Search ..... 102/200, 202.1, 202.2, 102/223, 263, 206

[56] References Cited

U.S. PATENT DOCUMENTS

| | | | |
|---|---|---|---|
| 4,037,537 | 7/1977 | Thorsell et al. | 102/200 |
| 4,056,059 | 11/1977 | Zebree | 102/200 |
| 4,417,519 | 11/1983 | Lutz | 102/263 |

*Primary Examiner*—Charles T. Jordan
*Attorney, Agent, or Firm*—L. Lawton Rogers, III; Joseph M. Killeen

[57] ABSTRACT

An arming device is interposed in the electrical circuit between the electrical switch at a control site and a remote explosive. The arming device is physically located near the explosive and is connected by a fluid pressure line to a pressure source at the control site. Until such time as the arming device is activated, the danger of premature detonation of the explosive from current induced in the conductor between the explosive and the switch is eliminated, and the fluid-pressure controlled arming device is not susceptible to such induced current. Both piston and diaphragm-type arming devices are disclosed.

13 Claims, 7 Drawing Figures

INDUCED CURRENT-PROOF DETONATING SYSTEM AND METHOD

BACKGROUND OF THE INVENTION

The present invention relates to an induced current-proof detonating system and method and more particularly to a detonating system and method in which the possibility of a premature explosion from current induced in the conductor connecting the control site to the remote explosive by natural or man-made electromagnetic fields is significantly reduced.

Conventionally, explosive devices such as dynamite are generally detonated at a remote location by the manual operation of a switch at a control site. By the operation of the switch, power is supplied by an electrical conductor to the detonating device. This electrical conductor is, for safety reasons, often of considerable length and the individual connecting the conductor to the detonator is in danger of premature detonation until he can clear the area. This danger exists even when the conductor is not connected to the switch, because the conductor may act as an antenna and have current induced therein as a result of either natural (e.g., lightning) or man-made (e.g., radio telephone signals, power line coupling) electromagnetic fields or electrical fields (e.g., downed power lines). In addition to the injuries at blasting sites, the danger of premature detonation results in the loss of a significant number of man hours where safety requires that blasting operations be suspended because of sporadic local thunderstorm activity, the presence of citizen band radio transmissions, etc.

It is accordingly an object of the present invention to provide a novel detonator system and method in which the risk of premature detonation is materially reduced.

It is another object of the present invention to provide a novel and inexpensive piston-type arming device for use in detonation systems.

It is a further object of the present invention to provide a novel and inexpensive diaphragm-type arming device for use in detonation systems.

These and many other objects and advantages of the present invention will be readily apparent from the claims and from the following detailed description when read in conjunction with the appended drawings.

THE DRAWINGS

DETAILED DESCRIPTION OF THE PREFERRED EMBODIMENTS

Figure 1:
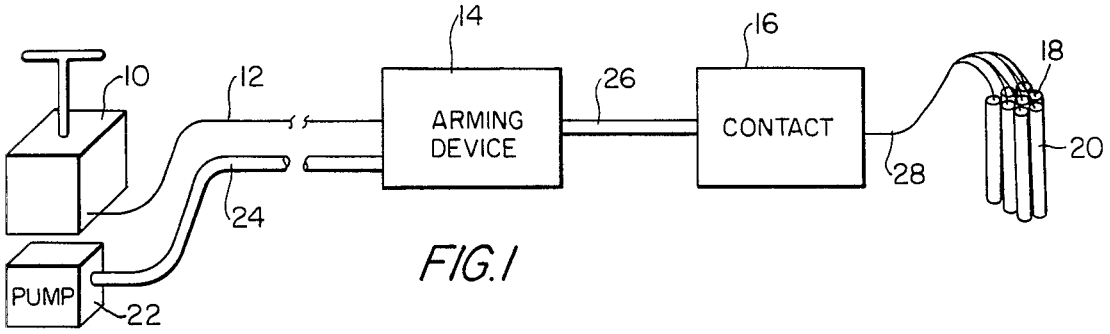
FIG. 1 is a pictorial representation of the system of the present invention.

With reference to FIG. 1, the system of the present invention is pictorially illustrated as including a plunger-type switch 10 electrically connected by way of a conductor 12 through the arming device 14 to the contact 16 of a detonator 18 pictorially illustrated as a cap to a dynamite charge 20.

With continued reference to FIG. 1, the pump 22 at the control site may be connected by a tube 24 to the arming device 14 at the remote location. The arming device 14 includes the reservoir for an electrically conductive fluid which, under the influence of pressure from the pump 22 via tubing 24, effects the filling of a tube 26 with the electrically conductive fluid to thereby connect the conductor 12 to the contact 16. Without this fluid pressure responsive connection, the explosive 20 is electrically connected only to a short length of wire 28 associated with the detonator 18. Thus any current induced in the conductor 12 by the presence of an electromagnetic field cannot be passed to the detonator 18.

In operation, the explosive 20 may be placed in the desired position with the arming device 14, the tube 26, and the detonator 18 contact 16 in close proximity thereto. The conductor 12 and tube 24 may then be connected to the arming device and run over a safe distance to the location from which the operation is to be controlled. Activation of the pump 22 from the control site only after all personnel have safely cleared the blasting area to apply pressure to the arming device 14 will effectively establish the electrical connection between the conductor 12 and the detonator 18, thus arming the detonator 18 for activation in response to the manual operation of the switch 10.

The system of FIG. 1 incorporates a suitable conventional electrical switch and pressure source 22, as well as a conventional detonator 18.

Figure 2:
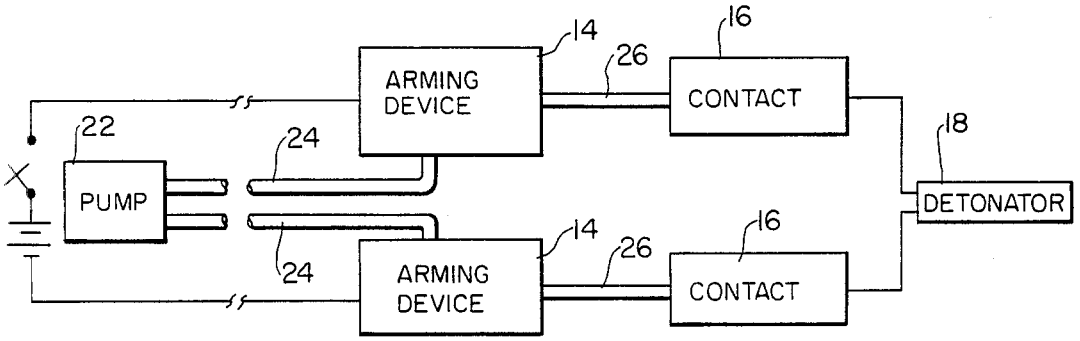
FIG. 2 is a schematic diagram of one embodiment of the present invention.

The system of FIG. 1 may be adapted for two-wire use as shown in FIG. 2 by utilization of two arming devices 14, tubes 26, and contacts 16. In such a two-wire embodiment, it may be desirable to utilize dual tubes from the pump 22, one each to the arming devices 14. Alternatively, a single tube may be used to simultaneously apply pressure to both of the arming devices 14.

Figure 3:
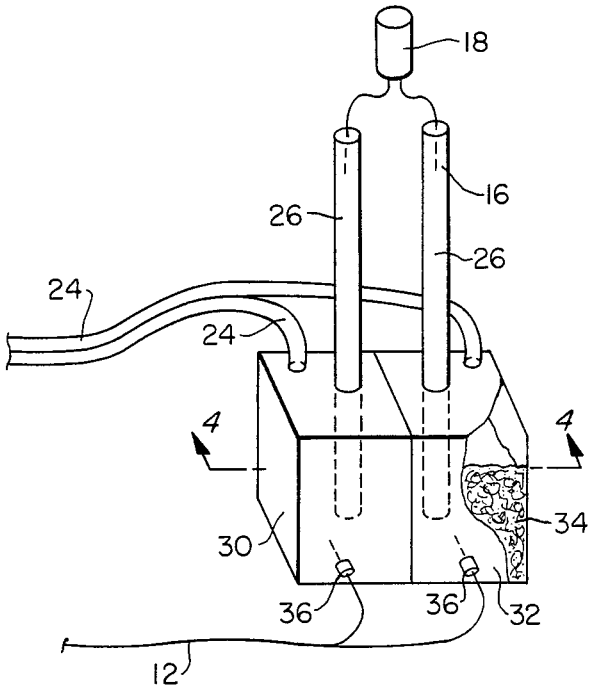
FIG. 3 is a pictorial representation of one embodiment of the arming device of the present invention.
Figure 4:
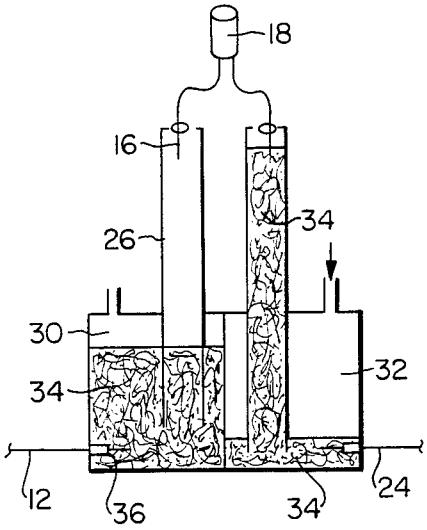
FIG. 4 is a section taken through lines 4—4 of FIG. 3.

A better understanding of the operation of the arming device 14 of FIGS. 1 and 2 may be gained with reference to FIGS. 3 and 4 where an exemplary structure is illustrated. As shown in FIGS. 3 and 4, the illustrated arming device 14 includes two reservoirs 30 and 32, both containing a suitable conventional electrically conductive solution 34. The electrical conductor 12 from the power source and switch (not shown) may be connected to a pair of electrodes 36 projecting respectively in a suitable conventional manner into the interior of the reservoirs 30 and 32.

Also as shown in FIG. 3, two tubes 24 may be connected respectively from the pump 22 (not shown) at the site of the electrical switch 10 of FIG. 1 to communicate with the upper portions respectively of the chambers 30 and 32.

With continued reference to FIGS. 3 and 4, a pair of generally upright tubes 26 are illustrated as projecting into the top of the reservoirs 30 and 32 to a point spaced from but adjacent to the bottom of the reservoirs. The tubes 26 are desirably of short length, e.g., approximately one foot, and are of a insulative or electrically non-conductive substance such as a thermoplastic. The contacts 16 are illustrated as projecting into the top of the tubes 26 and are in electrical contact with the detonator 18.

In operation, the application of a positive pressure to the upper portion of one of the reservoirs will effect a displacement of the electrically conductive fluid therefrom, forcing the conductive fluid 34 to rise within the tube 26 into contact with the contact 16 associated with the detonator 18. This completes the electrical circuit between the conductor 24 and the detonator 18 as shown in the right hand position of FIG. 4.

Clearly, the device illustrated in FIGS. 3 and 4 could easily be adpated for single reservoir operation, for one rather than two arming tubes, for a single rather than two wires to the detonator so long as the other wire is appropriately grounded, or for use with either or both positive and negative pressures to control the level of the electrically conductive fluid which arms the circuit. Such modifications are easily within the level of skill of one skilled in this art.

Figure 5:
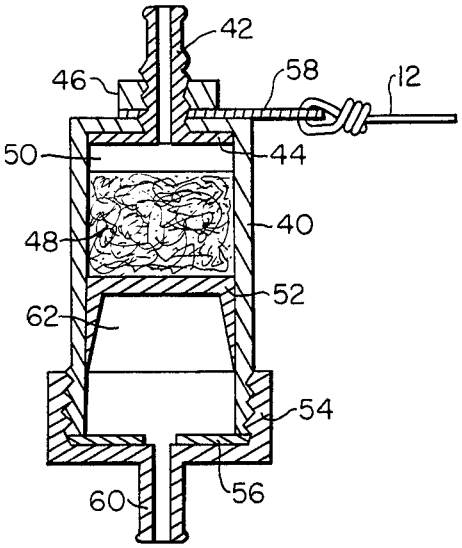
FIG. 5 is an elevation in cross-section illustrating one embodiment of the piston-type arming device of the present invention.

A preferred embodiment of the arming device of the present invention is illustrated in FIG. 5 as including a cylinder 40 opened at one end and having an axial aperture on the upper end through which a fitting 42 may be inserted by insertion into the open end of the housing 40. As illustrated in FIG. 5, the fitting 42 is desirably provided with a flange 44 and effects a fluid-tight seal under the pressure of a nut 46 threaded onto the portion of the fitting 42 external of the housing. In addition to the seal, the flange 44 increases the surface area for contact by the electrolyte 48 within the chamber 50 formed at the upper end of the housing 40 by a piston 52.

The lower end of the housing 40 is desirably externally threaded to receive a screw-on end cap 54 and gasket 56. The end cap 54 is desirably provided with a fitting to which the fluid pressure control line may be attached.

The housing 40 and the end cap 54 are desirably made of an electrically non-conductive material such as a conventional thermoplastic material, as is the piston 52. The fitting 42 is desirably constructed of a non-corrosive material such as stainless steel and serves as the contact for the electrical conductor 12 attached by way of a suitable conventional fitting such as the contact lug 58 illustrated in FIG. 7. The electrical contact may be made from the conductor 12 in any suitable conventional manner to the contact lug 58 and from there either directly to the fitting 42 or through the lug 46 to the fitting 42.

While not shown in FIG. 5, the tube 26 of FIGS. 1–4 may be secured to the fitting 42 and may contain at the upper end thereof any suitable conventional electrical contact 16 adapted to be connected to the detonator 18.

In operation, the application of a positive pressure to the fitting 60 formed on the end cap 54 will increase the pressure within the chamber 62 formed by the end cap 54, housing 40, and piston 52, and thus effect movement of the piston 52 upwardly to force the conductive fluid into the fitting 42 and up the tube 26 (not shown). The application of a negative pressure to the chamber 62 will effect the reverse movement of the piston 52 to clear the electrical contact with the detonator as may be appropriate.

Figure 7:
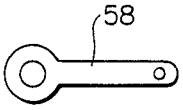
FIG. 7 is a top plan view of one embodiment of a connector lug utilized in the embodiments of FIGS. 5 and 6.
Figure 6:
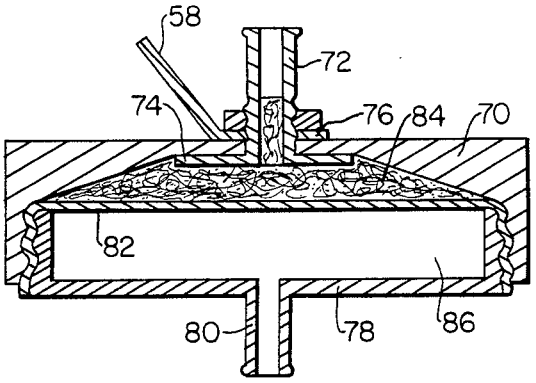
FIG. 6 is an elevation in cross-section illustrating one embodiment of the diaphragm-type arming device of the present invention.

A second embodiment of the arming device 14 of FIGS. 1 and 2 is illustrated in FIG. 6. With reference to FIG. 6, a shallow cylindrical housing 70 may be internally threaded at the open end thereof and be provided with an aperture at the upper end. A fitting 72 may thus be inserted through the open end of the housing 70 and protrude through an axial aperture in the upper end thereof. The fitting 72, like the fitting 42 of the device of FIG. 5, may be provided with a flange 74 to effect the liquid-tight seal under the application of pressure from the nut 76. As in the embodiment of FIG. 5, a lug 58 such as illustrated in FIG. 7 may be provided for electrical contact with the conductor 12.

With continued reference to FIG. 6, an end cap 78 with a molded fitting 80 may be threadably secured to the housing 70 to define an internal chamber. A diaphragm 82 may be secured between the housing 70 and the end cap 78 to separate the electrically conductive solution 84 from the pressure chamber 86.

In operation, the application of a positive pressure through the fitting 80 will pressurize the chamber 86, displace the diaphragm 82 upwardly and thereby force the electrically conductive solution 84 through the fitting 72 into the tube 26 (not shown) to thereby complete the circuit from the lug 58 to the contact 16 of the detonator. The application of a negative pressure to the fitting 80 will, of course, reverse the movement of the diaphragm 82 and cause the electrolyte 84 to flow downwardly under the pressure of gravity into the chamber.

The arming devices 14 illustrated in FIGS. 5 and 6 may be carried to the blasting site filled with the conducting fluid. Suitable conventional plugs (not shown) may be removed from the fittings at the time that the device is mechanically connected to the tube 26 and its contact 16. By using the arming device to delay the electrical connection of the detonator to the conductor 12, the possibility of the conductor 12 serving as an antenna responsive to either natural or man-made electromagnetic fields can be eliminated. Work at the blasting site may thus continue even in presence of intermittent thunderstorm activity or citizens band radio transmissions.

Although previously described in association with FIGS. 3 and 4 as operating in response to fluid pressure, the embodiments described above can also function in response to a vacuum or negative pressure by changing the position of the tubing 24 from communicating with the chambers 30 and 32 to communicating with the upper portion of the upright tubes 26. If a partial vacuum is then applied to the tubing 24, the electrically conductive solution 34 will rise within the tube 26 into contact with the contact 16, completing the electrical circuit between the conductor 12 and the detonator 18.

Many other modifications of the present invention will be readily apparent to one skilled in the art, being understood that the scope of the invention is defined by the appended claims when accorded a full range of equivalents, rather than by the illustrative embodiments disclosed.

I claim:

1. A spurious electromagnetic energy resistant explosive detonating system comprising:

a source of electrical power at a control site;

an explosive detonator at a location remote from the control site;

an elongated electrical conductor;

a selectively operable switch at the control site for electrically connecting said source to one end of said conductor;

an arming device at the remote location for electrically connecting the other end of said conductor to said detonator;

a selectively operable source of fluid pressure differential at the control site; and an electrically non-conductive tube in fluid communication with said fluid pressure source and said arming device, said arming device being responsive to the selective operation of said fluid pressure differential source for electrically connecting the other end of said conductor to said detonator to thereby arm the detonating system for the selective application of electrical power from said source to said detonator by said switch.

2. The system of claim 1 wherein said arming device comprises:

an electrically non-conductive reservoir;

a volume of electrically conductive fluid within said reservoir; and first and second electrical contacts disposed within said reservoir in position to be submerged within said fluid by the selective operation of said source of fluid pressure differential at the contact site.

3. The system of claim 2 wherein said arming device includes two chambers;

wherein said conductive fluid is disposed in one of said chambers; and wherein the relative size of said two chambers is controlled by the selective operation of said source of fluid pressure differential at the control site.

4. The system of claim 3 wherein said two chambers are separated by a slidable piston.

5. The system of claim 3 wherein said two chambers are separated by a diaphragm.

6. In a system for detonating an explosive at a remote location by the operation of a switch at a control site to connect electrical power to a detonator at the remote location over an electrical conductor, the improvement comprising:

a fluid pressure differential operated arming device at the remote location for electrically connecting said conductor to said detonator, and fluid pressure differential means at the control site for selectively operating said arming device immediately prior to desired detonation to electrically connect said switch to said detonator so that the subsequent operation of said switch will apply electrical power to said detonator through said conductor and said arming device.

7. An explosive detonator arming device comprising:

an electrically insulative reservoir containing an electrolyte;

an electrical lead in physical contact with the electrolyte within said reservoir adjacent the bottom thereof;

a generally upright, electrically insulative tubing in fluid communication at one end with the interior of said reservoir adjacent the bottom thereof;

an explosive detonator having an electrical contact disposed within said upright tubing adjacent the upper end thereof; and a source of fluid pressure differential for selectively displacing electrolyte from the upper portion of said reservoir through said tubing into physical engagement with said contact to thereby selectively establish an electrical connection between said lead and said contact.

8. A fluid pressure differential responsive arming device for an electrical detonating system having a selectively operable switch connected to a remote detonator by an elongated electrical conductor comprising:

an electrically insulative housing having a first fitting at one end;

an electrically conductive second fitting communicating with the interior of said housing at the other end;

an insulative tube interiorly communicating with said conductive fitting;

a detonator contact disposed within said tube;

means interiorly of said housing to divide the interior thereof ino a first chamber adjacent said one end and a second chamber adjacent said other end; and an electrolyte disposed within said second chamber;

whereby the application of fluid pressure through said first fitting to said first chamber effects movement of said means toward said other end to displace electrolyte from said second chamber into said tube, thereby establishing an electrical contact between said first fitting and said detonator contact through said electrolyte.

9. The arming device of claim 8 wherein said dividing means include a piston slidably mounted within said housing.

10. The arming device of claim 8 wherein said dividing means include a diaphragm.

11. The arming device of claim 8 wherein said first fitting comprises a metal tube having one end adapted for insertion into a flexible non-metallic tubing and having at the other end a flange, said tube being externally threaded adjacent said flange.

12. The arming device of claim 8 wherein said housing comprises a cylinder open at one end and having an axial aperture at the other end.

13. In a system for detonating an explosive at a remote location by the operation of a switch at a control site to connect electrical power to a detonator at the remote location by way of an elongated electrical conductor, the method of reducing the danger of premature detonation from electromagnetic field induced current in the conductor comprising the steps of:

(a) providing a fluid pressure differential operated arming device at the remote location for electrically connecting said conductor to said detonator, (b) selectively operating the arming device immediately prior to desired detonation from the control site by fluid pressure differential to electrically connect the switch to the detonators, and (c) operating the switch to apply electrical power to the detonator through the conductor and the arming device.

* * * * *